United States Patent [19]

Beal et al.

[11] 4,315,401

[45] Feb. 16, 1982

[54] AFTERBURNER FLAMEHOLDER CONSTRUCTION

[75] Inventors: George W. Beal; James R. Grant, Jr., both of Palm Beach Gardens; Kurt J. Hanloser, Lake Park, all of Fla.

[73] Assignee: United Technologies Corporation, Hartford, Conn.

[21] Appl. No.: 99,054

[22] Filed: Nov. 30, 1979

[51] Int. Cl.[3] ..... F02K 3/10; F02K 3/04

[52] U.S. Cl. ..... 60/261; 60/262

[58] Field of Search ..... 60/261, 262

[56] References Cited

U.S. PATENT DOCUMENTS

| | | | |
|---|---|---|---|
| 3,100,627 | 8/1963 | Wilde | 60/262 |
| 3,295,325 | 1/1967 | Nelson | 60/261 |
| 3,540,216 | 11/1970 | Quillevene et al. | 60/261 |
| 4,145,880 | 3/1979 | Markowski | 60/261 |
| 4,170,109 | 10/1979 | Egan | 60/261 |
| 4,185,458 | 1/1980 | Ernst | 60/261 |

*Primary Examiner*—Robert E. Garrett

*Attorney, Agent, or Firm*—Jack N. McCarthy

[57] ABSTRACT

An afterburner on a turbofan engine includes a flameholder means having an annular flameholder gutter positioned downstream of a first exhaust means of a core engine while said flameholder means also includes a plurality of radial gutter sections extending radially outward towards an outer wall of said afterburner and downstream of a second annular exhaust means of a bypass duct around said core engine; a plurality of said radial gutter sections having a manifold extending along the forward portion thereof, each manifold having an inlet at its inward end located downstream of said first exhaust means with said manifold directing a hot exhaust flow from said inlet to openings on each side of its associated radial gutter section in a portion downstream of said second annular exhaust means.

5 Claims, 4 Drawing Figures

AFTERBURNER FLAMEHOLDER CONSTRUCTION

The Government has rights in this invention pursuant to Contract No. F33657-76-C-0408 awarded by the Department of the Air Force.

BACKGROUND OF THE INVENTION

This invention relates to the use of flameholders with afterburners having an annular bypass air exit into an afterburner around exhaust flow from a core engine. The patents to Nelson, U.S. Pat. No. 3,295,325 and to Riecke, U.S. Pat. No. 3,485,045, show afterburners for bypass engines having flameholder constructions. Nelson uses a specific shape of a flame stabilizing ring to force hot air or flame outwardly and Riecke uses scoops on his annular flameholder to cause a positive transfer of flame outwardly. The patent to Marshall et al, U.S. Pat. No. 3,800,527, shows a heat shield for preheating a flameholder. The patents to Pierce, U.S. Pat. No. 2,978,865 and to Coplin et al, U.S. Pat. No. 3,330,117, and to Kohler et al, U.S. Pat. No. 3,595,024, provide means for mixing bypass air and core engine air.

SUMMARY OF THE INVENTION

A primary object of the present invention is to provide for flame stability during afterburning in the afterburner of a turbofan engine.

In accordance with the present invention, a flameholder includes an annular gutter-type flameholder having a plurality of radially extending gutter-type extensions. Said annular gutter-type flameholder being located rearwardly from the exhaust of said core engine with some radial flameholder sections extending inwardly and some extending outwardly into the exhaust of the fan air. A plurality of said outwardly extending radial flameholders having a manifold formed around the forward part thereof along its entire length with an inlet scoop in line with gases exiting from said core engine. Said manifold carrying the heated exhaust air from said core engine to the outer portion of said radial flameholder where it is directed rearwardly from each side thereof.

DESCRIPTION OF THE PREFERRED EMBODIMENT

Figure 1:
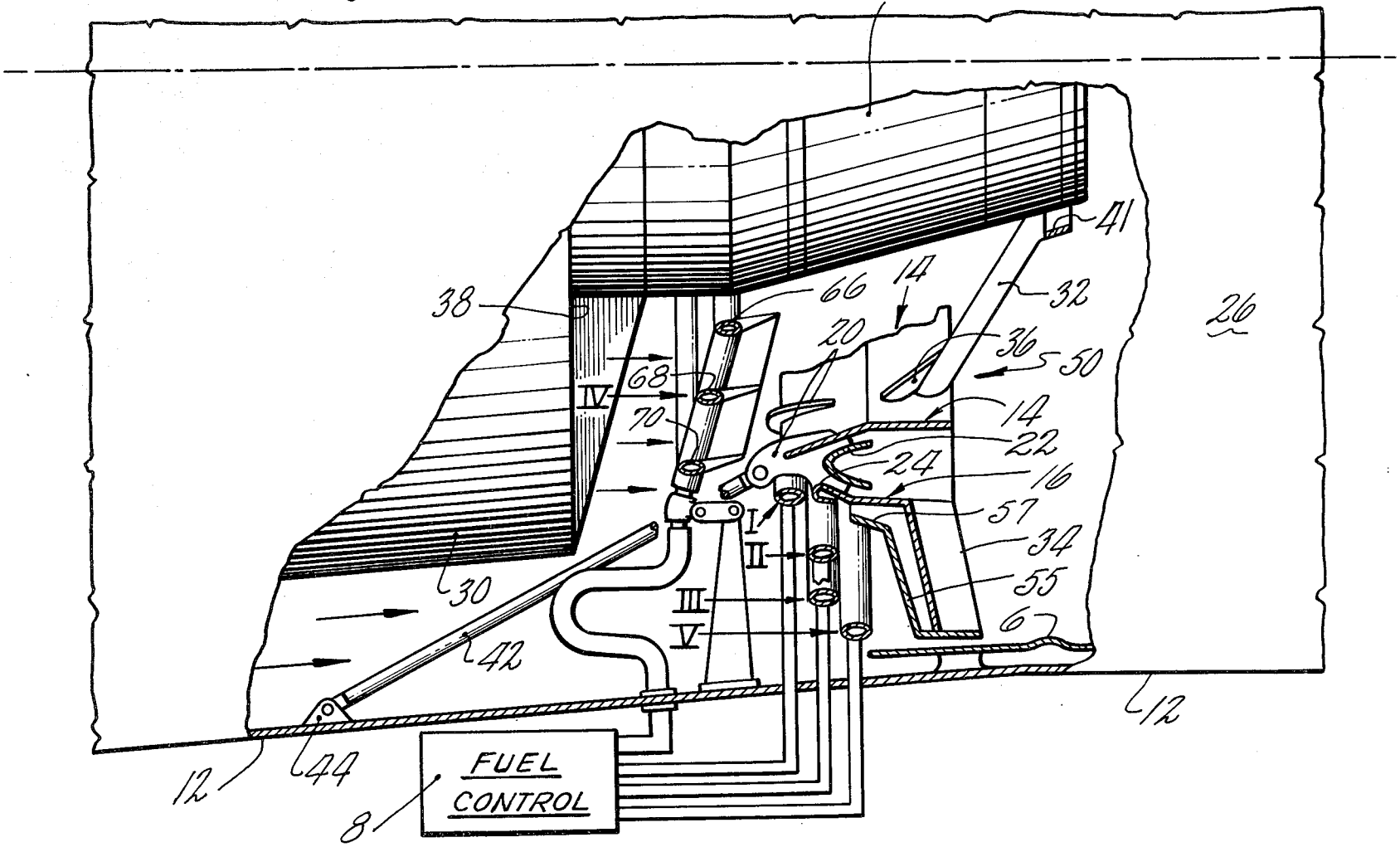
FIG. 1 is a view of a portion of the turbofan engine broken away showing the core engine exhaust and fan exhaust entering into an afterburner with the flameholder shown partially in section.

Referring to FIG. 1, we see the outer engine case 12 of a turbofan engine, such as shown in U.S. Pat. No. 3,295,325. The turbofan engine directs fan flow through annular bypass air passage 30 where it is discharged into afterburner section 26. Exhaust from the core engine is discharged through annular gas passage 38 in afterburner section 26. A reheat process takes place in afterburner section 26 and this requires the injection of additional fuel in the afterburner section 26 and the establishment of a flow stabilization zone in the afterburner section 26 so that combustion may take place therein. Flameholder 50 performs the flame stabilization zone creating function.

Referring to FIG. 1, we see flameholder 50 and its support mechanism in greater particularity. Flameholder 50 is supported between the engine center body 40 and outer case 12 in a manner to be hereinafter described. The afterburner section 26 is formed having a cooling liner 6 spaced inwardly from the outer case 12. The forward end of the liner 6 is located as far forward as possible to have only the cooler outer air directed therethrough.

A fuel system including a fuel control 8 delivers a scheduled fuel supply to five fuel injection zones, I, II, III, IV and V. As the afterburner is ignited, fuel is directed to Zone I. As the power lever is advanced, fuel is also directed to Zone II, then to Zone III and then to Zone IV. Zone IV comprises a set of three radially spaced conventional sprayrings 66, 68 and 70. Fuel is then directed to Zone V.

Flameholder 50 is formed having a pair of spaced annular walls 14 and 16. While the rearward portions of the walls 14 and 16 are spaced approximately parallel, the forward portions taper inwardly toward each other and are fixed together by a plurality of spaced support plates 20. The plates 20 extend into the area between the walls 14 and 16 and support an annular flameholder gutter 22 therein. The forward end of the wall 14 is straight but the forward end of the wall 16 is curved, as at 24. The opening between the forward end of wall 14 and the curved forward end 24 of the wall 16 is positioned axially in line with the exhaust opening from the core engine; therefore, exhaust gases flowing from the core engine are directed over the flameholder gutter 22. As is shown in prior art patents set forth above, radially extending flameholder gutter sections 32 extend inwardly from wall 14 and radially extending gutter sections 34 extend outwardly from wall 16. These radial flameholder gutter sections 32 and 34 are welded to their respective walls 14 and 16 with the respective wall cut out within the gutter end so that the flame can extend from within walls 14 and 16 through the radial gutter sections.

Twenty-four equally spaced radial gutter sections 34 extend outwardly and eight equally spaced radial gutter sections 32 extend inwardly. The radial gutter sections 32 and 34 were spaced so that one gutter section 32 lined up with one gutter section 34. The inner end of each gutter section 32 where it is welded to wall 14 is also supported by a plate 36 which is welded to each gutter section 32 and plate 14. Further the inner end of each gutter section 32 is formed having flanges 38 extending to each side thereof. Adjacent flanges 38 of gutter sections 32 are connected together by a plate member 41. This provides for rigidity in the construction of the flameholder 50.

A plurality of the support plates 20 around the flameholder 50 extend forwardly and additional amount so that the support end of an attaching rod 42 can be fixed thereto, (see FIG. 1) such as by bolting. The forward end of each of the rods 42 is attached by a bracket 44 fixed at spaced points around the inner side of engine case 12. These rods 42 position and support the flameholder 50.

Figure 2:
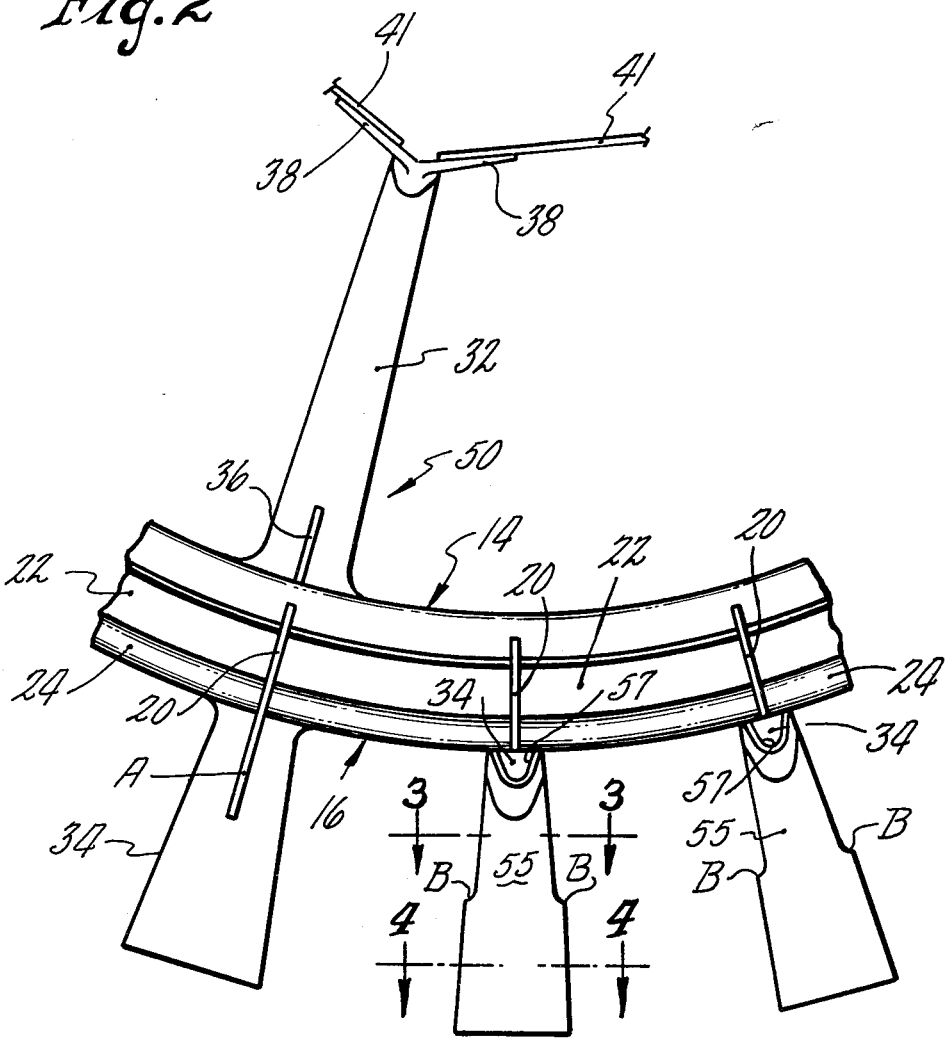
FIG. 2 is an enlarged view of a portion of the flameholder as it is viewed from the front thereof in FIG. 1.

The eight radial gutter sections 34 which are aligned with the eight radial gutter sections 32, have the support plates 20 extending over the curved end 24 and along the outer surface of wall 16 and extending outwardly along the center of the gutter sections 34 for added rigidity. These gutter sections 34 are wider than the gutter sections which are not aligned. This can be seen at A in FIG. 2. The support plates 20 are welded in place.

Each of the two outwardly extending radial gutter sections 34, located between the radial gutter sections 34 aligned with the radial gutter sections 32, are formed with a manifold 55 welded in position around each radial gutter section 34.

Figure 3:
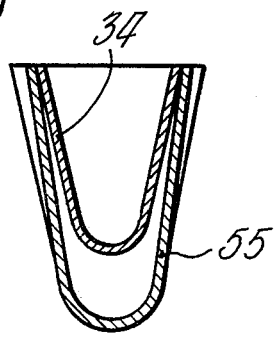
FIG. 3 is an enlarged view taken on the line 3—3 of FIG. 2.
Figure 4:
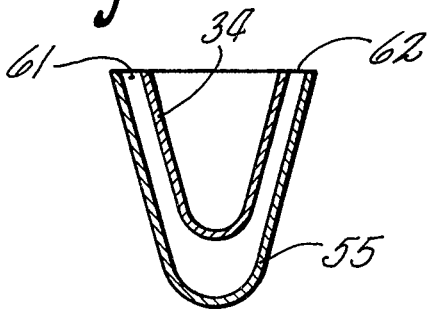
FIG. 4 is an enlarged view taken on the line 4—4 of FIG. 2.

Each manifold 55 has a forwardly extending inlet 57 which is welded in position to the outer surface of wall 16. The forwardly extending inlets 57 are positioned axially in line with the exhaust opening from the core engine so that exhaust gases flowing from the core engine can be directed into each opening 57 and through each associated manifold 55. Manifold 55 has its rearward edges welded to its cooperating radial gutter section 34 outwardly to point B (see FIG. 3); at that point, the end of manifold 55 is spaced from the rear end of the radial gutter section 34 forming two axial openings 61 and 62 for the outer portion of the radial gutter section 34. It can be seen that hot exhaust gases from the core engine will be delivered through the inlet 57 and the manifold 55 to the openings 61 and 62 on each side of the associated radial gutter section 34. In one construction built, the inlets 57 were sized to receive 1% of the hot exhaust gases passing from the core engine.

We claim:

1. In combination, a core engine, a bypass duct around said engine, said core engine having a first exhaust means discharging a hot exhaust, said bypass duct having a second annular exhaust means directing a cooler flow therefrom, said first and second exhaust means opening directly into an afterburner, said afterburner having an outer wall extending downstream from said bypass duct, a flameholder means in said afterburner downstream of said first and second exhaust means, said flameholder means having an annular gutter section positioned downstream of said first exhaust means in said hot exhaust, a plurality of radial gutter sections extending radially outward from said flameholder means through said hot exhaust of said first exhaust means and into said cooler flow of said second exhaust means towards said outer wall of said afterburner downstream of said second exhaust means, a plurality of said radial gutter sections having a manifold on the forward portion thereof, each manifold having an inlet opening located downstream of and in line with said first exhaust means, each manifold having outlet openings on each side of said radial gutter section and in a portion downstream of and in line with said second annular exhaust means, said manifold directing hot exhaust flow from its inlet opening to its outlet openings.

2. A combination as set forth in claim 1 wherein each manifold directs a hot exhaust flow from said inlet opening located between the manifold and radial gutter section to outlet openings formed between said manifold and the cooperating radial gutter section.

3. A combination as set forth in claim 1 wherein the outlet openings are only located at the outer radial portion of the radial gutter section.

4. A combination as set forth in claim 1 wherein said outlet openings are elongated in a radial direction.

5. A combination as set forth in claim 1 wherein each manifold covers the forward portion of its cooperating radial gutter section.

* * * * *